US008575868B2

(12) United States Patent
Caporaso et al.

(10) Patent No.: US 8,575,868 B2
(45) Date of Patent: Nov. 5, 2013

(54) VIRTUAL GAP DIELECTRIC WALL ACCELERATOR

(75) Inventors: George James Caporaso, Livermore, CA (US); Yu-Jiuan Chen, Fremont, CA (US); Scott Nelson, Patterson, CA (US); Jim Sullivan, Livermore, CA (US); Steven A. Hawkins, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 873 days.

(21) Appl. No.: 12/761,607

(22) Filed: Apr. 16, 2010

(65) Prior Publication Data

US 2011/0101891 A1 May 5, 2011

Related U.S. Application Data

(60) Provisional application No. 61/170,057, filed on Apr. 16, 2009.

(51) Int. Cl.
*H05H 9/00* (2006.01)

(52) U.S. Cl.
USPC ..... 315/505; 313/359.1

(58) Field of Classification Search
USPC ..... 315/500, 505; 313/359.1
See application file for complete search history.

(56) References Cited

U.S. PATENT DOCUMENTS

| | | | | |
|---|---|---|---|---|
| 5,757,146 | A * | 5/1998 | Carder | 315/505 |
| 5,811,944 | A * | 9/1998 | Sampayan et al. | 315/505 |
| 5,821,705 | A * | 10/1998 | Caporaso et al. | 315/507 |
| 6,278,239 | B1 * | 8/2001 | Caporaso et al. | 315/5.41 |
| 7,576,499 | B2 * | 8/2009 | Caporaso et al. | 315/505 |
| 2007/0092812 | A1 | 4/2007 | Caporaso et al. | |
| 2009/0261258 | A1 | 10/2009 | Harris et al. | |

OTHER PUBLICATIONS

G.J. Caporaso et al., "Compact accelerator concept for proton therapy" Apr. 22, 2007, Elsevier, Science Direct.com, Nuclear Instruments and Methods in Physics Research B 261 (2007) 777-781.

G.J. Caporaso, et al., "Status of the dielectric wall accelerator", Proceedings of Particle Accelerator Conference 2009, pp. 1-5.

* cited by examiner

*Primary Examiner* — Thuy Vinh Tran
(74) *Attorney, Agent, or Firm* — John P. Wooldridge

(57) ABSTRACT

A virtual, moving accelerating gap is formed along an insulating tube in a dielectric wall accelerator (DWA) by locally controlling the conductivity of the tube. Localized voltage concentration is thus achieved by sequential activation of a variable resistive tube or stalk down the axis of an inductive voltage adder, producing a "virtual" traveling wave along the tube. The tube conductivity can be controlled at a desired location, which can be moved at a desired rate, by light illumination, or by photoconductive switches, or by other means. As a result, an impressed voltage along the tube appears predominantly over a local region, the virtual gap. By making the length of the tube large in comparison to the virtual gap length, the effective gain of the accelerator can be made very large.

40 Claims, 23 Drawing Sheets

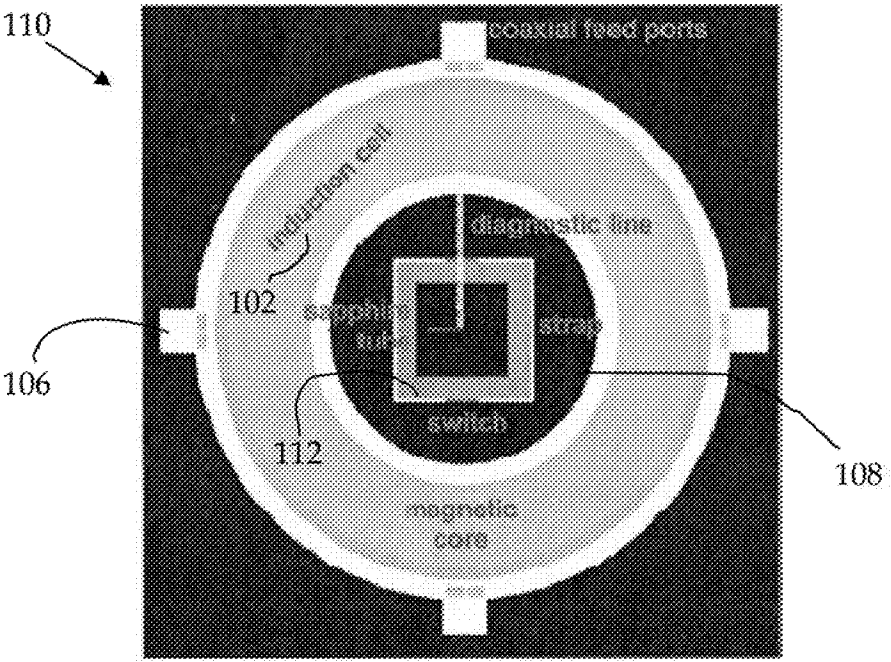
110
106
102
Potential feed points
Magnetic core
Magnetic core
Magnetic core

VIRTUAL GAP DIELECTRIC WALL ACCELERATOR

RELATED APPLICATIONS

This application claims priority to U.S. Provisional Application Ser. No. 61/170,057, titled "Virtual Gap Dielectric Wall Accelerator," filed Apr. 16, 2009, incorporated by reference.

GOVERNMENT RIGHTS

The United States Government has rights in this invention pursuant to Contract No. DE-AC52-07NA27344 between the United States Department of Energy and Lawrence Livermore National Security, LLC.

BACKGROUND OF THE INVENTION

1. Field of the Invention

This invention pertains generally to particle accelerators, and more particularly to dielectric wall accelerators.

2. Description of Related Art

In a conventional induction accelerator, the beam pipe is conducting, so that an accelerating electric field is present only in the gaps between accelerator stages. Thus the accelerating field occupies only a relatively small fraction of the axial length of an accelerator cell.

In a dielectric wall accelerator (DWA), an insulating wall replaces the conducting beam pipe. The dielectric wall is energized by a pulsed power system. The accelerating fields can then be applied uniformly over the entire length of the accelerator, yielding a much higher gradient, e.g. 20 MeV/m or more, compared to about 0.75 MeV/m. A high gradient DWA can thus be made much more compact than a comparable conventional induction accelerator.

A number of technological developments have led to DWA designs with greatly enhanced performance. An insulator material, called a "high gradient insulator" (HGI), made of alternating layers of conductor and insulator with periods on the order of a mm or less, has a much higher surface flashover threshold than monolithic insulators. Solid dielectrics have high bulk breakdown strength and can be used in high voltage pulse generators. Photoconductive switches using wide band gap materials such as SiC or GaN are compatible with very high voltage gradients and are advantageous to initiate the output voltage pulse in a DWA.

An important part of the DWA is the pulse forming system. A wide variety of pulse generating lines employing closing switches are generically referred to as "Blumleins." These lines are made up of two or more transmission lines, either planar strip lines or radial lines. The Blumlein is actuated to generate a pulse by closing a switch, typically a photoconductive switch. In a typical DWA configuration, two stacks of strip Blumleins are placed on opposite sides of the beam tube.

To efficiently accelerate charged particles axially along the beam tube, the particles should always be embedded in an accelerating field. To do so, the region of the dielectric wall exposed to a high electric field must move along with the accelerating particles. This can be done by making the Blumleins relatively thin and activating them in sequence to produce a region of excitation along the wall that maintains synchronism with the charged particles. Thus, as the electric field produced by the pulse generating Blumleins propagates down the bore of the accelerator, it pushes the packet of charged particles before it.

Although it has higher impedance and requires fewer switches than a radial line, the strip Blumlein suffers from parasitic coupling between different lines in a stack. This coupling occurs because electric and magnetic fields leak axially from layer to layer. This leakage causes temporal distortion of the pulse and a reduction in amplitude. Thus, the accelerating gradient is reduced from its theoretical ideal value.

Other problems with Blumlein actuated DWAs include the large number of switches required for the accelerator, about one switch per mm; the relatively large energy required to achieve high gradient, and the total laser energy required for the accelerator. During charging of the lines, the Blumlein switches are in the off state, and are subject to large voltage gradients for long periods of time, typically hundreds of nanoseconds or longer, producing high electrical stress on the switches. The Blumleins output into an open circuit to attain maximum gradient, leading to ringing of the lines and voltage reversals on the dielectric wall. There is also strong radial defocusing on the particle beam, and there is no room to add external focusing.

One area where a compact high gradient accelerator would be of great advantage is a proton accelerator for medical applications. The benefits of proton therapy over x-ray therapy are well known. However, at present proton beams are produced in very large accelerators, and very few medical facilities have such a machine. A compact proton accelerator that could replace x-ray machines would greatly expand the availability of proton treatment.

SUMMARY OF THE INVENTION

The invention is a dielectric wall accelerator in which a virtual moving accelerating gap is formed along an insulating beam tube by controlling the conductivity of the tube sequentially at localized regions by light illumination or other means so as to have an impressed voltage along the tube appear predominantly over a local region, the virtual gap, which moves along the tube. If the applied voltage across the tube is V and the gap width is w, acceleration through a tube of length l can result in an energy gain up to lV/w.

One way to locate the gap is by controlling the illumination of a photoconductive layer over an insulating tube of arbitrary cross-section. The illumination provides for a relatively high conductivity over most of the length of the tube such that the voltage applied across the length of the tube appears primarily over a small region from which illumination is absent. The tube is basically the stalk in an inductive adder. By changing the illumination pattern on the photoconductor, the accelerator configuration, i.e. gap location, can be changed.

Alternately, a series of adjacent photoconductive switches can be arranged to lie tangent to an insulating tube or insulated segments in place of a photoconductive tube, and individual switches momentarily turned off to remove illumination from a local region. The voltage applied across the tube may come from an electrostatic source or from an inductive voltage adder that is powered either externally, or internally by charged capacitors and series switches that connect the capacitors across induction gaps between cells.

Another way to generate a virtual gap is to place small photoconductive switches between each segment of a high gradient insulating (HGI) tube. All the switches are illuminated except where the virtual gap is desired.

Focussing, both linear and nonlinear, can be added. For example, if two strips 180° apart are illuminated, two virtual gaps may be formed that provide both acceleration and a quadrupole field. By spiraling the strips around the tube in a helical trajectory, a net transverse focusing force will be developed in all transverse directions. Any number of strips may be used in a similar manner to apply sextupole, octopole, or higher order fields. These virtual lenses or focusing sections can be created at any point along the tube by proper control of the illumination pattern or by laying down photoconductive material in the appropriate locations.

An additional means to provide focusing is to shape the insulating segments that hold the photoconductive switches and interconnecting conductors to have chevron ("V") shapes. The chevron shaped segments lead to the generation of transverse electric fields that are proportional to the accelerating field that is developed along the tube. The chevron shaped segments can be alternated by 90° to provide alternating gradient focusing. The chevron shaped segments can be generalized to produce dipole, quadrupole, and higher order multipole fields. The chevron electrode concept may also be implemented by placing conductors on a cyclindrical tube where segments of the conductors are arcs of a helix that changes direction around the tube.

The voltage concentration works in two distinct regimes. The first, or subluminal regime, is appropriate for low particle energies. The condition for the subluminal regime is that the particle velocity is less than the speed of an electromagnetic wave along the coaxial system formed by the stalk and the inner surface of the induction cells. For higher particle energies, up to relativistic speeds, the second, or superluminal regime, is appropriate, where the particle speed is greater than the speed of an electromagnetic wave along the coaxial stalk-induction cell system. In this case, a low loss magnetic core can be placed radially between the resistive tube and the induction cells to reduce the speed of the electromagnetic wave below the particles. Another superluminal topology is to replace the stalk with a helical conductor to slow the electromagnetic wave speed. In this configuration the induction cells are powered internally with charged capacitor banks and series switches, e.g. light controlled resistors. By varying the conductivity of the individual induction cell switches in the appropriate pattern, a concentrated axial electric field can be made to move along the helix at a speed controlled by the timing of the switches in the induction cells.

Further aspects of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus and method generally shown in FIG. 1A through FIG. 9. It will be appreciated that the apparatus may vary as to configuration and as to details of the parts, and the method may vary as to its particular implementation and as to specific steps and sequence, without departing from the basic concepts as disclosed herein.

The invention is a dielectric wall accelerator (DWA) in which a virtual, moving accelerating gap is formed along an insulating tube by controlling the conductivity of the tube at sequential local regions thereof. Localized voltage concentration is achieved by sequential activation of high resistance along a variable resistive tube or stalk down the axis of an inductive voltage adder, producing a "virtual" traveling gap along the tube. The tube conductivity can be controlled at a desired location, which can be moved at a desired rate, by light illumination, or by photoconductive switches, or by other means. As a result, an impressed voltage along the tube appears predominantly over a local region (the virtual gap) where the resistance is high. By making the length of the tube large in comparison to the virtual gap length, the effective gain of the accelerator can be made very large.

Figure 1A:
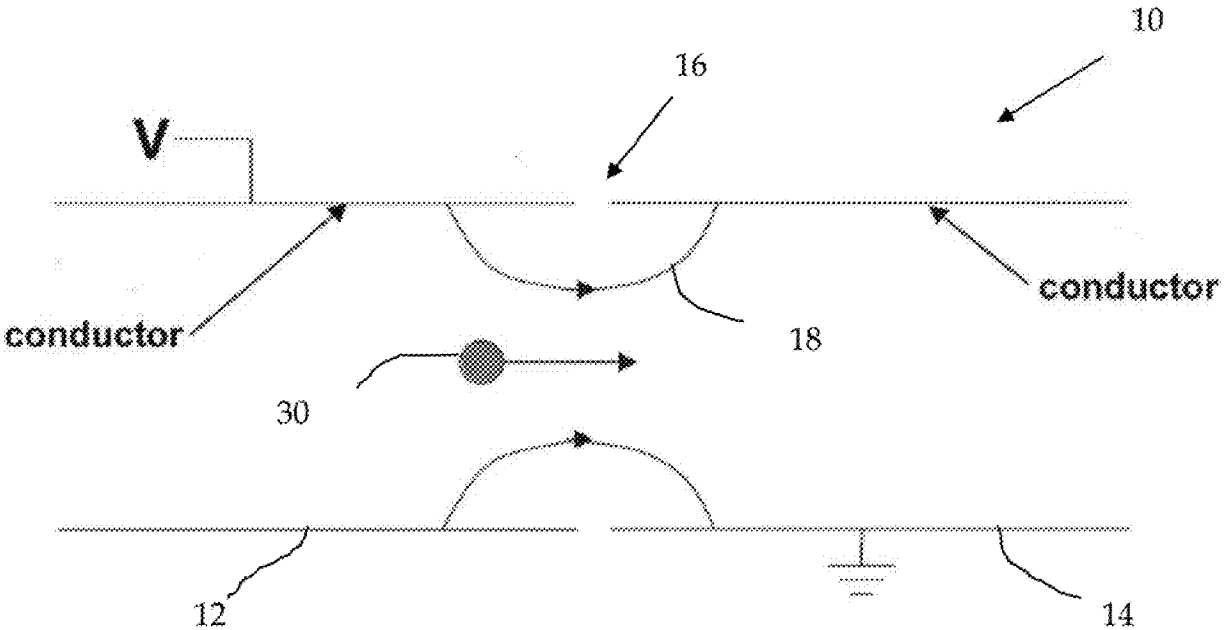
FIGS. 1A-D illustrate the basic principles of the invention.

FIG. 1A shows a conductive tube 10 made up of two segments 12, 14 separated by a narrow gap 16 around the tube. One end of tube 10, i.e. segment 12, is connected to a voltage source V, and the other end of tube 10, i.e. segment 14, is connected to ground. The voltage drop V along tube 10 will then occur almost entirely at the gap 16, because gap 16 represents a nonconductive or highly resistive region along the conductive or low resistivity tube 10. This voltage drop at the gap 16 will produce an electric field or lens 18 in the tube 10. Electric field 18 would accelerate a charged particle 30 that passes axially through tube 10.

However, the charged particle would only be accelerated once, when it passes the stationary electric field 18 at gap 16. In an accelerator, a particle must be accelerated many times to achieve high energy. Of course, an accelerator could be built with many stages similar to that shown in FIG. 1A, each with a single stationary gap, but this would require a long length.

Figure 1B:
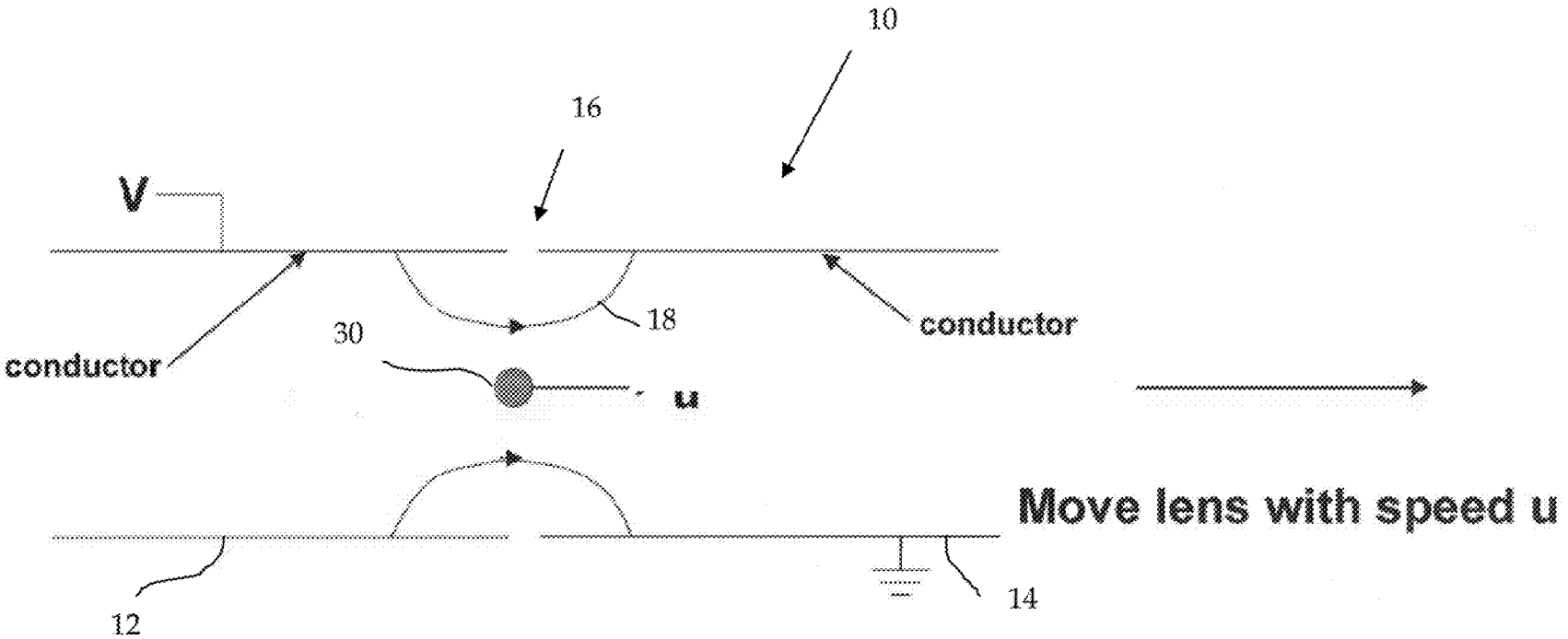

Conceptually, as shown in FIG. 1B, the electric field lens 18 could be moved at a velocity "u" by moving the tube 10 with a velocity "u" as shown by the arrow. The moving lens 18 would then continue to accelerate a co-moving charged particle 30. However, in practice moving the beam tube 10 any distance at a speed matching the charged particle 30 is impossible. What is needed is a way to implement the concept of moving the lens 18 in a stationary beam tube 10.

Figure 1C:
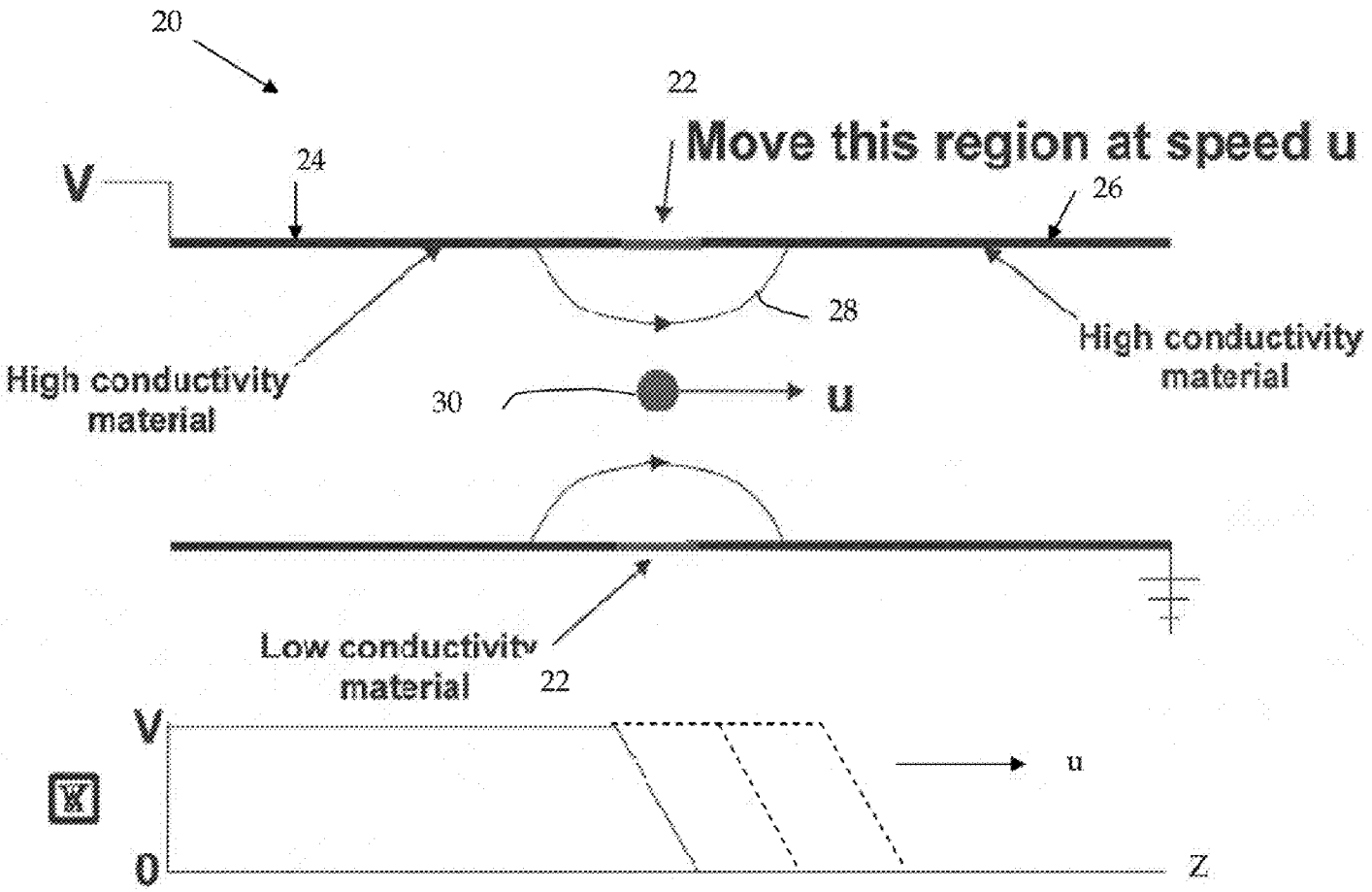

FIG. 1C shows a conceptual way of achieving the implementation of moving the lens in a stationary beam tube. Beam tube 20 is made of a high conductivity material whose conductivity can be rapidly changed from a high conductivity state to a low conductivity state and back again. One end of tube 20 is connected to a voltage source V and the other end to ground. If a small localized region 22 between high conductivity segments 24, 26 of tube 20 is made temporarily low conducting, then the voltage drop V along tube 20 will again occur almost entirely at low conductivity region 22, as shown in the accompanying voltage graph. Thus region 22 becomes the equivalent of gap 16 and an electric field or lens 28 equivalent to lens 18 will be formed in tube 20 at region 22. Because region 22 is not a physical gap in tube 20, it can be made to move along stationary tube 20 by locally changing the conductivity of tube 20 along its length as a function of time. Thus the low conductivity region 22 can be moved at a speed "u" along the length of high conductivity tube 20, so that it is synchronized with a co-moving particle 30. The voltage drop then propagates along the tube with a speed "u" as shown in the voltage graph. Region 22 is referred to as a virtual gap because it is not a physical gap but has the properties of one.

Figure 1D:
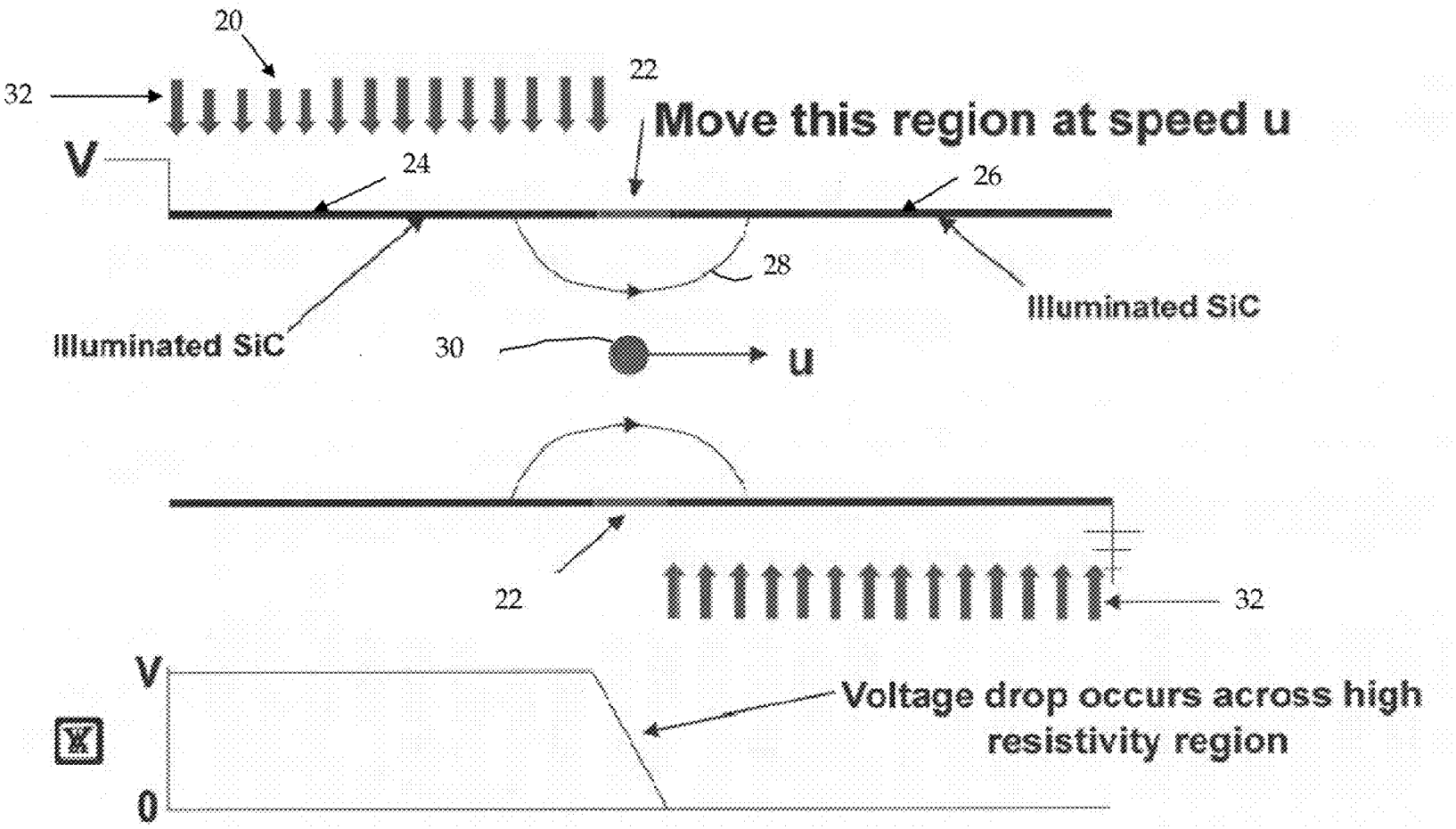

One way to implement the virtual gap concept of FIG. 1C is shown in FIG. 1D, using laser light to locally control conductivity. Beam tube 20 is made of silicon carbide SiC, which has the property that it is highly conductive when illuminated and highly resistive when not illuminated. Laser light 32 of an appropriate wavelength illuminates all of tube 20 except for narrow region or gap 22, i.e. tube segments 24 and 26 are illuminated and thus highly conductive while region or virtual gap 22 is highly resistive. The illumination pattern of the laser light 32 can be translated at a speed "u" axially along the length of tube 20 to make virtual gap 22 move at a speed "u" along tube 20.

A practical way to implement the above-described concept of a virtual gap dielectric wall accelerator is to use a structure that is placed entirely within conventional induction cells. An induction voltage adder is a known device in which the voltages of a number of individual induction cells are summed up and the total voltage appears across a relatively narrow gap where it is impressed across a load. Thus the voltage of the entire structure is concentrated into the relatively small stationary gap in a conventional induction voltage adder.

The gap in an induction voltage adder can be made into a moving virtual gap by replacing the interior of the induction voltage adder with a stalk made of a material whose conductivity can be varied on command. This variable conductive material can be placed on the outer diameter of a "high gradient insulator" (HGI) beam tube. The conductivity of this layer of material is modulated locally and rapidly to create a moving virtual gap of low conductivity surrounded by high conductivity everywhere else along the tube. This moving virtual gap concentrates the voltages of the induction cells in a moving localized region. The virtual gap is moved in synchronization with a packet of charged particles moving down the tube so that the particles experience a continuous acceleration.

Figure 2A:
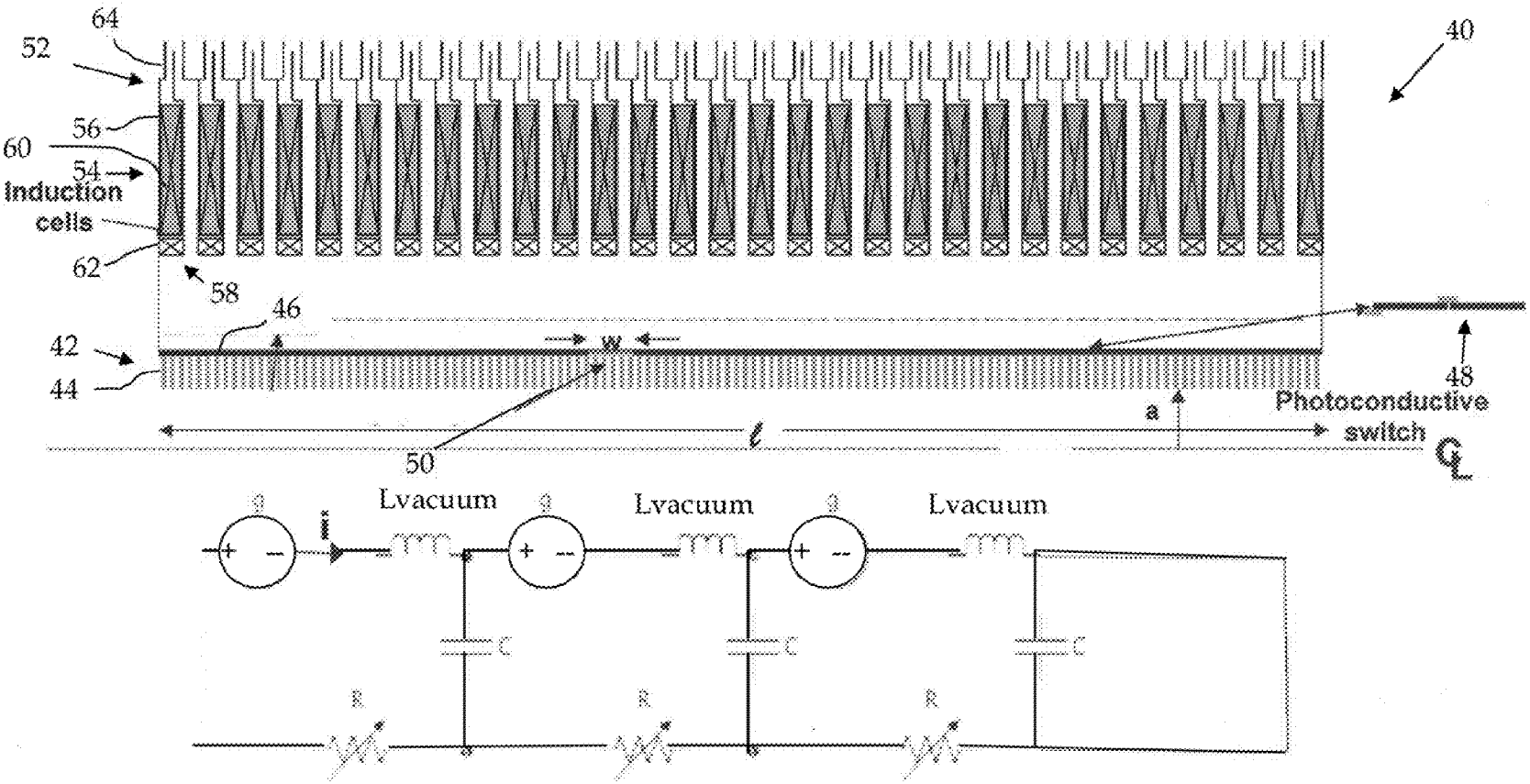
FIGS. 2A-C are cross-sectional views of three embodiments of the virtual gap accelerator of the invention, along with simple circuit models thereof.

FIG. 2A shows a virtual gap dielectric wall accelerator (voltage adder) 40 in which the virtual gap is created by shutting off photoconductive switches. Accelerator 40 has an insulating beam tube (stalk) 42 made up of a high gradient insulator (HGI) tube 44 with an outer layer 46 of a material of controllable conductivity. A plurality of photoconductive switches 48 are connected in series and positioned along the length of beam tube 42 to form layer 46 and are used to produce the moving virtual gap (w) 50 of high resistivity. The material of layer 46 has high conductivity when illuminated so initially all the switches 48 are on. As each switch 48 in sequence is temporarily closed, that portion of layer 46 is temporarily changed to low conductivity, creating the virtual gap 50. The speed at which successive switches 48 are closed and then turned back on determines the speed at which the virtual gap 50 propagates along the length of tube 42. The layer 46 made up of switches 48 does not have to encircle the tube 44 but may be a strip along the surface providing a conductive path where the conductivity can be changed locally by individual switches 48. Conductors connected to the switches 48 will, however, encircle the tube 44 so that the voltage drop appears uniformly around the tube, creating a uniform electric field in the tube. Details of the switches 48 are described below with reference to FIGS. 3A-C.

Bank 52 of induction cells 54 outside of (encircling) beam tube 42 and electrically connected thereto provides the voltage that is applied to the virtual gap 50 to create the electric field. Each induction cell 54 is made up of a conductive housing 56 and is separated from the next cell 54 by a gap 58. Housing 56 contains a ferromagnetic induction core 60 and a focusing solenoid 62. Induction cells 54 are connected by coaxial cables 64 to an external power source (not shown). The common grounds are connected to all cells 54 while the center conductors are connected to individual cells 54. The housing 56 would short out the cable 64 except for the magnetic core 60, which provides a large inductance across the cable 64. This produces a voltage across the gaps 58 between cells 54. The output voltage of bank 52 is the sum of the voltages of each cell 54. The encircling induction cells 54 allows the incorporation of focusing elements (solenoids 62) inside the induction cells 54 to prevent beam defocusing.

FIG. 2A also includes a simple circuit model of the inductive voltage adder 40 with a variable conductivity stalk 42. The induction cells are represented by ideal voltage sources of "g" volts per unit length. The coaxial distributed inductance and capacitance per unit length between the stalk and cells are represented by series L ($L_{vacuum}$) and shunt C. Variable series resistance per unit length R represents the local variable conductivity of the tube. From the current and voltage equations for the circuit, the accelerating field can be calculated. The speed of an electromagnetic wave along the coaxial system formed by the stalk and the inner surface of the induction cells is given by $1/(LC)^{1/2}$.

There are two distinct regimes, subluminal and superluminal. The subluminal regime occurs when the speed of the virtual wave is less than the electromagnetic wave propagation speed. The superluminal regime occurs when the speed of the virtual wave is greater than the electromagnetic wave propagation speed.

Figure 2B:
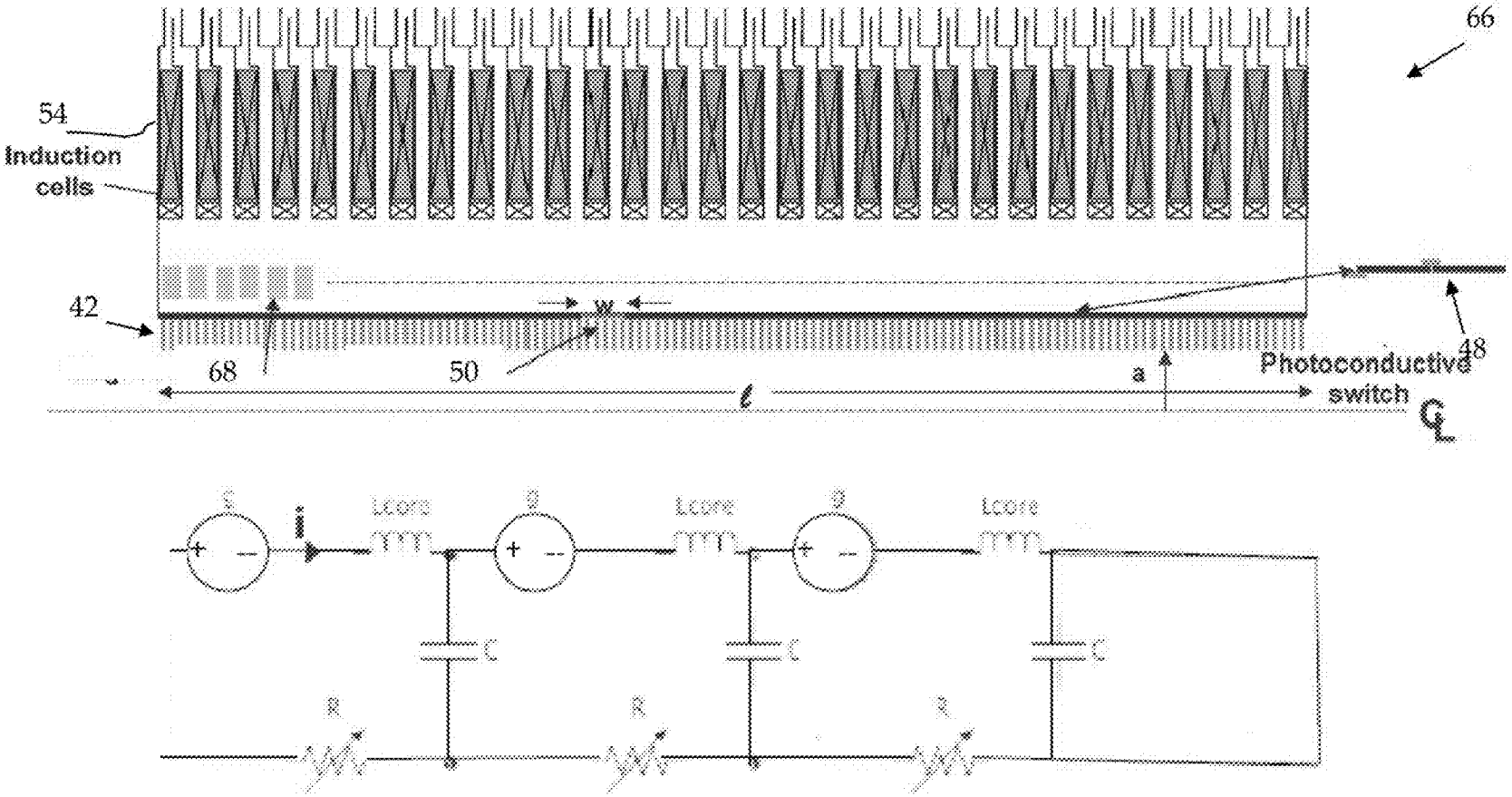

FIG. 2B shows a virtual gap dielectric wall accelerator (voltage adder) 66 which is similar to accelerator 40, except that magnetically permeable cores 68 have been added around the conducting beam tube (stalk) 42 to increase the series inductance per unit length. This is done to better enable the superluminal regime since it can increase the potential gain in the superluminal regime. The circuit diagram is similar to accelerator 40 but the series inductance $L_{core}$ is greater than $L_{vacuum}$.

Figure 2C:
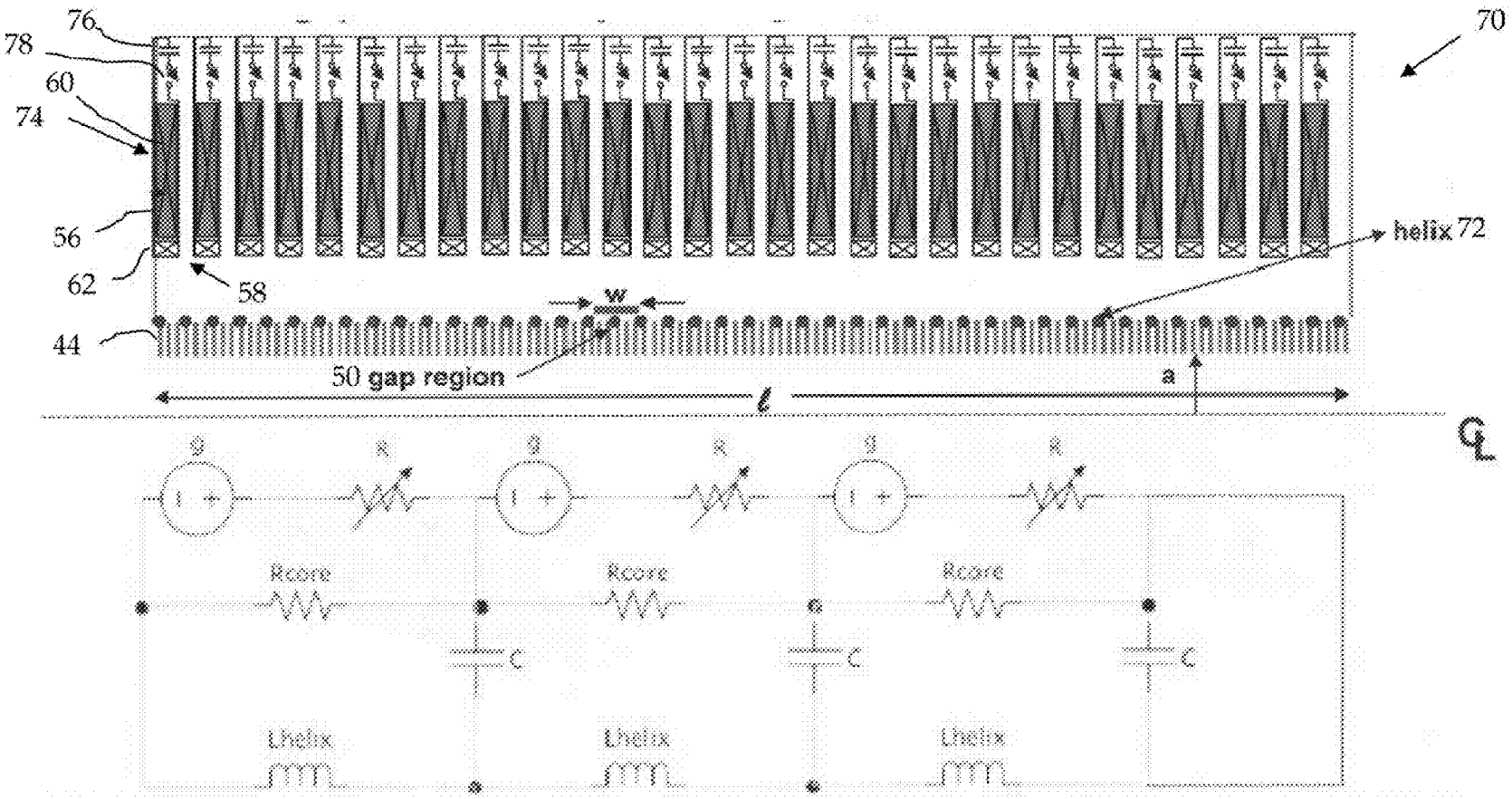

FIG. 2C shows a virtual gap dielectric wall accelerator (voltage adder) 70 which is a dual configuration to accelerator 40, but with the series resistance and inductance interchanged. A high gradient insulator (HGI) tube 44 forms the beam tube or stalk (without any outer layer of material of controllable conductivity as in accelerator 40). A helical conductor (helix) 72 is wound around HGI tube 44, and provides the inductance. The voltage on the tube causes current to flow through the helix 72. Induction cells 76 have a conductive housing 56 containing magnetic core 60 and solenoid 62 and separated by gaps 58, but are somewhat different in configuration. Induction cells 74 include a capacitor 76 and a switch 78 therein. Switches 78 are placed in series with capacitors 76 and the induction gaps 58 between cells 74 to power the cells 74. Switches 78 are closed to apply voltage from an external source (not shown) to induction cells 74 (at gaps 58) and charge capacitors 78. Switches 78 are then opened to interrupt current flow through the inductor to apply voltage to the virtual gap 50. There is no variable resistive region on the beam tube. Switches 78 are opened in sequence and inductively create the moving virtual gap 50.

DWA 70, like DWA 40, is designed for the superluminal regime, while DWA 20 is designed for the subluminal regime. An accelerator for low energy heavy ions could be subluminal. An accelerator in which the particles are injected at high energy could be a superluminal configuration. However, in some cases particles will be injected at low energy and accelerated to high energy so that both regimes are encountered. In this case the accelerator could have a first subluminal section followed by a second superluminal section. For example, the magnetic cores 68 in FIG. 2B could be placed from a midpoint position to the end, leaving an initial portion without the cores.

Figure 3A:
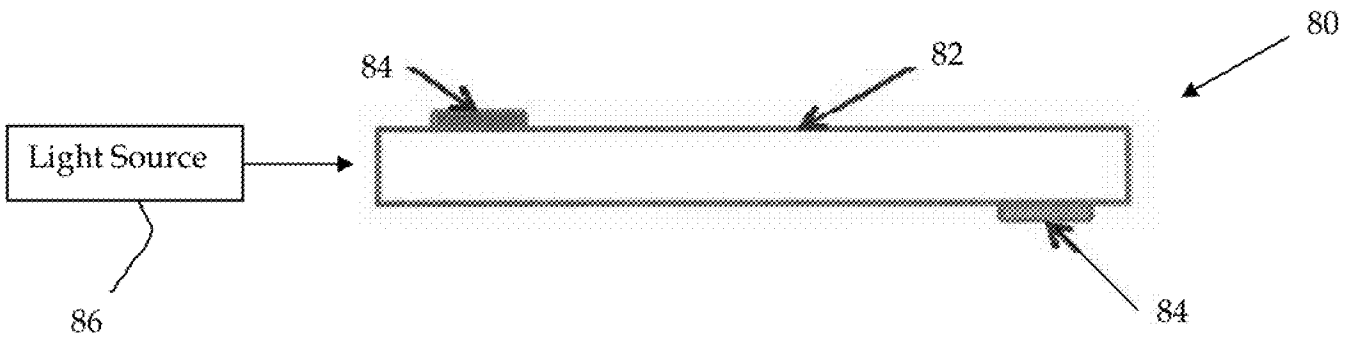
FIGS. 3A, B are side and top views of a photoconductive switch that can be used to form the virtual gap.
Figure 3B:
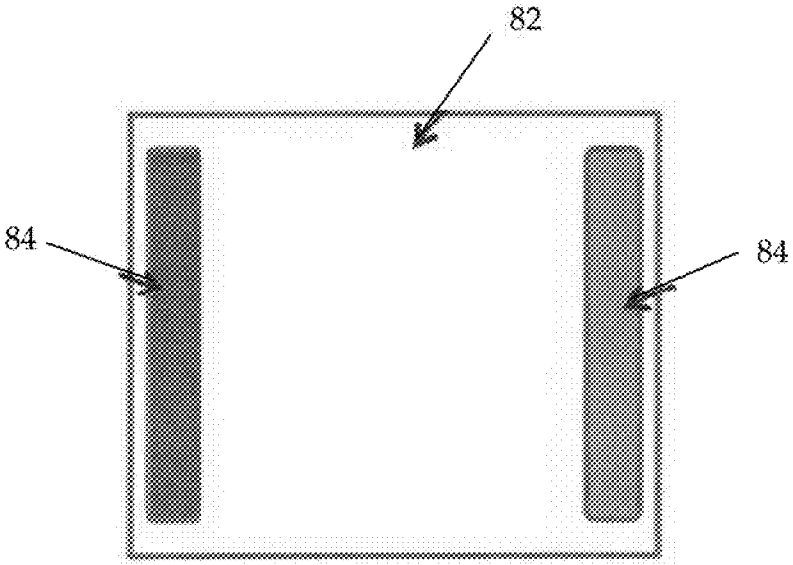
FIG. 3C is a side view of a multiple photoconductive switch assembly that can be used to form a sequence of virtual gaps.
FIG. 3D is a side view of a photoconductive switch that can be used in an induction cell and a graph showing its operation.

The operation of the virtual gap accelerator may use switches to change the conductivity of the tube; wide band gap photoconductive switches (photoswitches) are preferred. FIGS. 3A, B show a photoswitch 80 made of a photoconductive substrate 82 with a pair of electrodes 84 formed thereon, on opposed sides of the substrate and offset toward opposed ends. Electrodes 84 are offset so that when there is a voltage drop across the electrodes 84, the electric field produced will be substantially parallel to the plane of the substrate 82 (which is lying on the beam tube). Substrate 82 is a thin large area wafer of SiC or other material doped to make it photoconductive. Switch 80 is actuated by illumination from a light source 86, e.g. a laser. The optical energy injected into switch 80 preferably has a photon energy less than the band gap of substrate 82, but above band gap illumination can also be used. When the substrate 82 is illuminated, it is conductive and there is no voltage drop between the electrodes 84; when substrate 82 is not illuminated, its conductivity decreases and a voltage drop occurs between electrodes 84, creating the virtual gap.

Figure 3C:
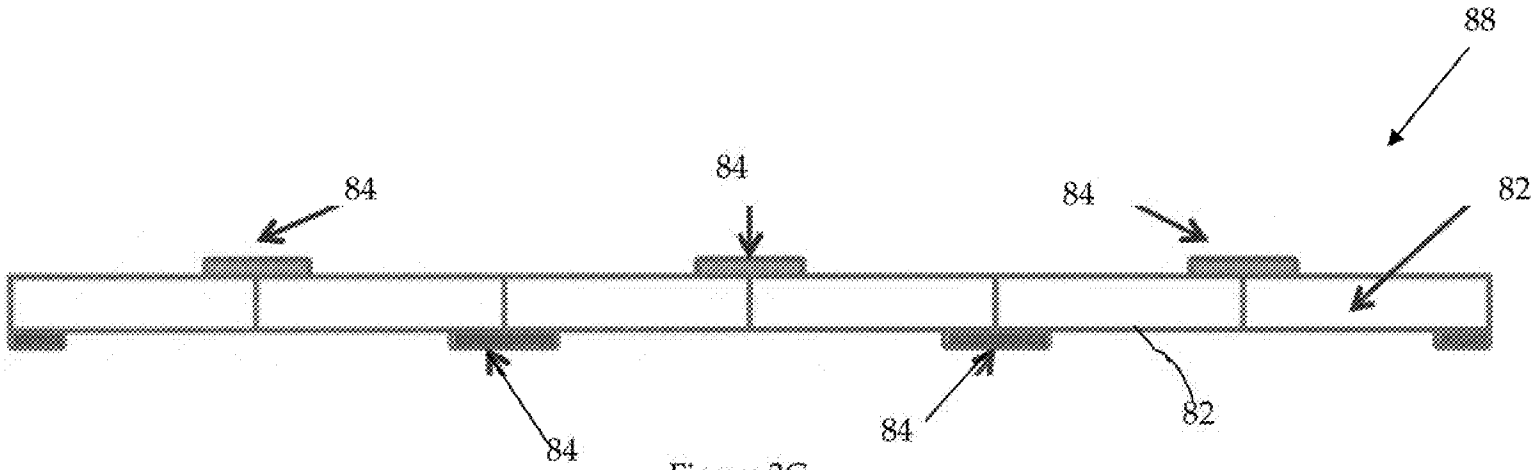

FIG. 3C shows a multiple photoswitch assembly 88 made up of multiple adjoining photoconductive substrates 82 with alternating top and bottom offset electrodes 84. Thus switch assembly 88 is essentially a plurality of individual switches 80 connected together in series. Switches 82 are illuminated from the open side. When they are all illuminated, a continuous conducting path along assembly 88 is formed. The illumination to any switch 82 in the series can be shut off, to make that switch open, i.e. resistive, causing a voltage drop thereat. Thus switch assembly 88 can form the conductive layer 46 in accelerator 40 in FIG. 2A.

Figure 3D:
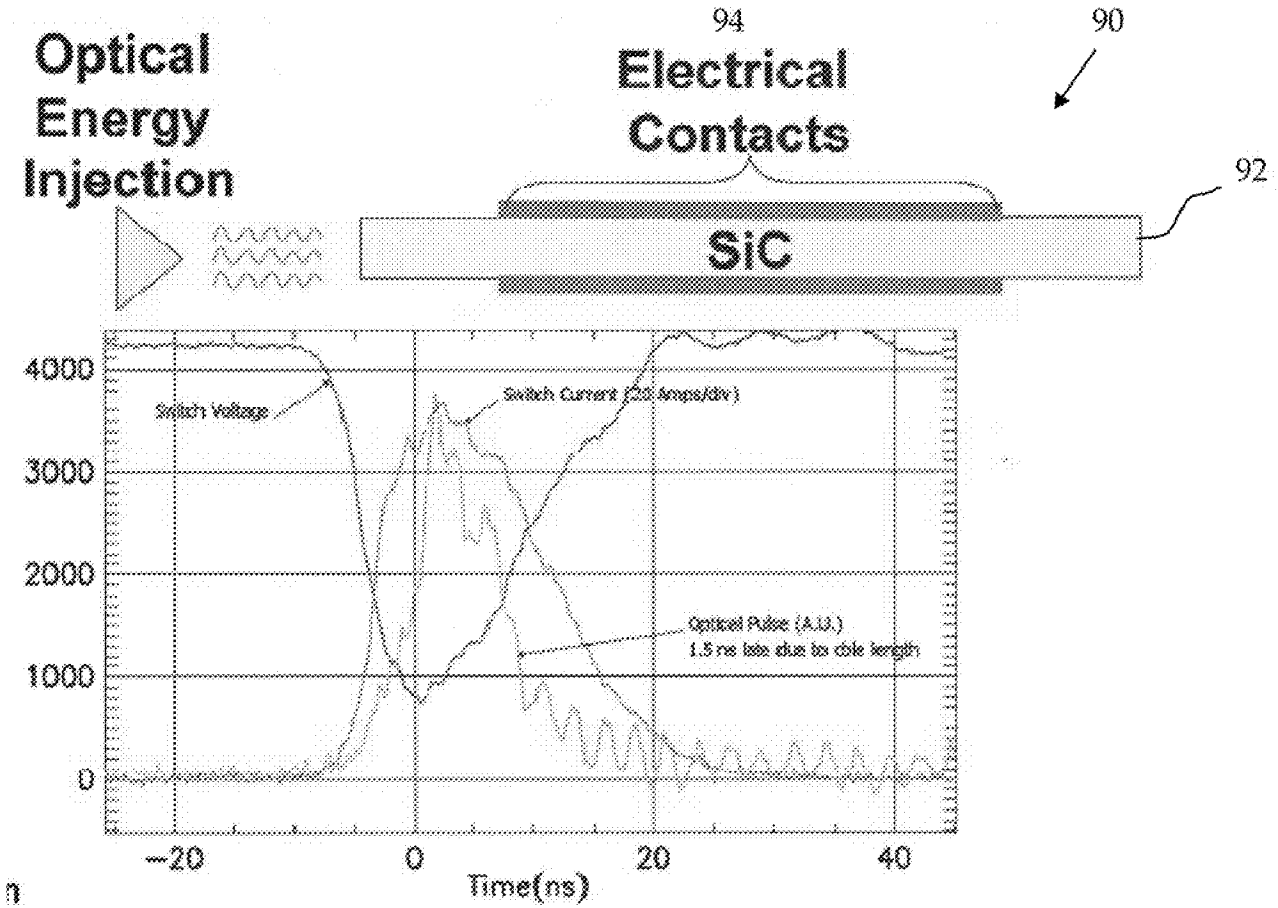

Photoconductive switches are also suitable for electrical connections, e.g. as switches 78 in induction cells 74 of accelerator 70 in FIG. 2C. As shown in FIG. 3D, photoswitch 90 is formed of a substrate 92 with a pair of aligned electrodes 84 on opposite sides. Substrate 92 is again a thin large area wafer of SiC or other photoconductive material. Switch 90 is actuated by optical energy. The accompanying graph shows a voltage between the electrodes when there is no light; a light pulse causes a voltage drop and current pulse because the switch becomes conducting. Photoswitch 90 could also be used in a beam tube to create the virtual gap when it is vertically oriented and integrated into the beam tube, e.g. within the layers of an HGI tube, instead of lying horizontally along the surface.

The photoconductive switches described above using wide band gap material with below band gap illumination are suitable for placement along the beam tube of a virtual gap DWA. The configuration permits the long axis of the switch elements to lay parallel to the accelerator axis. Electrodes are alternately placed on the top and bottom of the switch elements offset axially from each other so that the electric field is properly oriented. Another way of using these switches is to place individual switches between each layer of a high gradient insulating (HGI) tube, with the long axis of the switch in the radial direction and the plane of the switch perpendicular to the axis of the accelerator tube.

The photoconductive switches in general are preferably of a type with photoconductive wide band gap semiconductor material (used as a variable resistor) whose conduction response to changes in amplitude of incident radiation is substantially linear throughout a non-saturation region to enable operation in non-avalanche mode. The photoconductive material may be selected from, for example, silicon carbide, gallium nitride, aluminum nitride, boron nitride, and diamond.

A modulated radiation source is used to produce amplitude modulated radiation which is directed on the variable resistor to modulate its conduction response, in particular within the non-saturation region. The modulated radiation source is preferably a modulated electromagnetic radiation source, e.g. a laser or an x-ray source, or a modulated particle radiation source, e.g. an electron (beta particle) source.

Figure 4A:
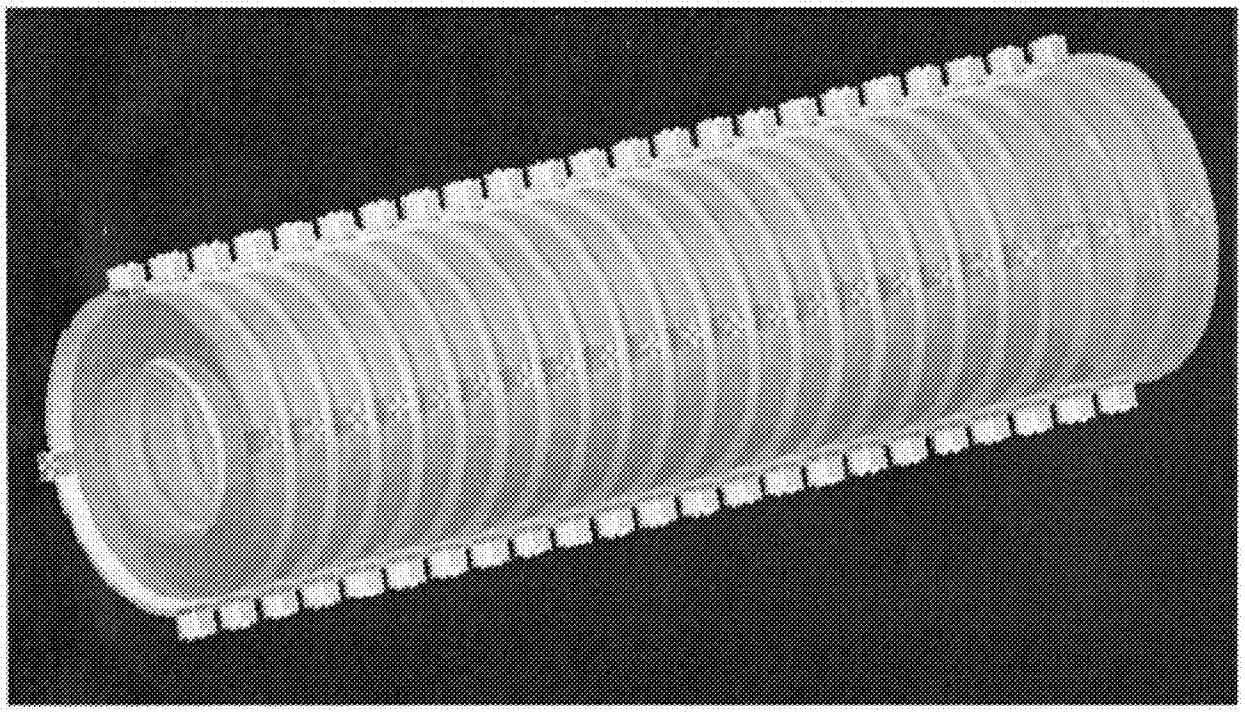
FIG. 4A is a perspective view of a bank of induction accelerator cells.

FIG. 4A shows a bank 100 of induction cells 102 separated by gaps 104. Four coaxial feeds 106 drive each induction cell 102. A beam tube whose conductivity can be locally controlled as described above is placed in the center channel 108

Figure 4C:
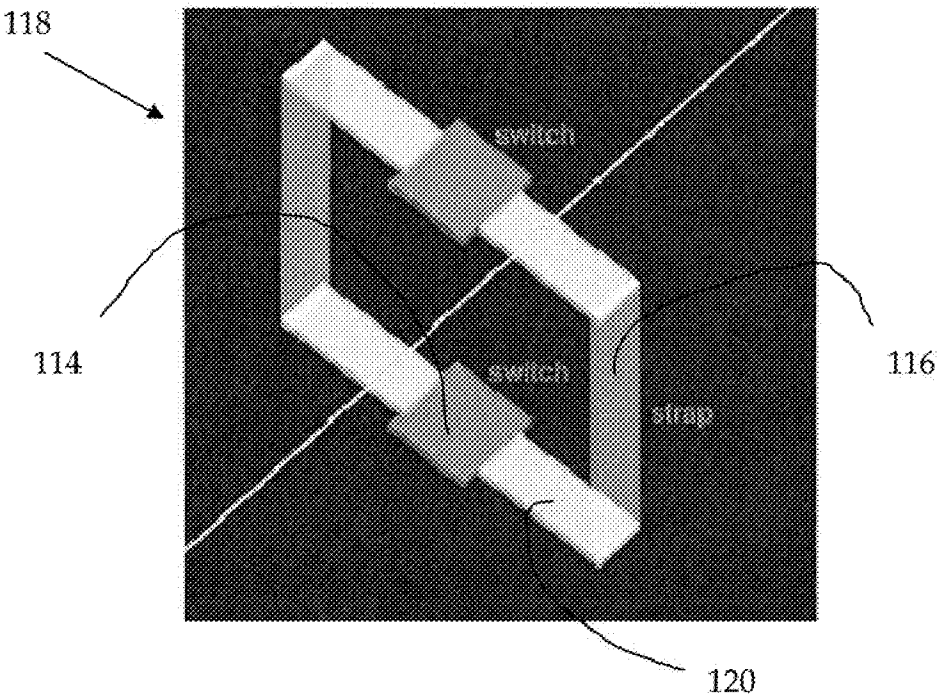
FIGS. 4C, D show a switch element and a series assembly of switch elements.
Figure 4D:
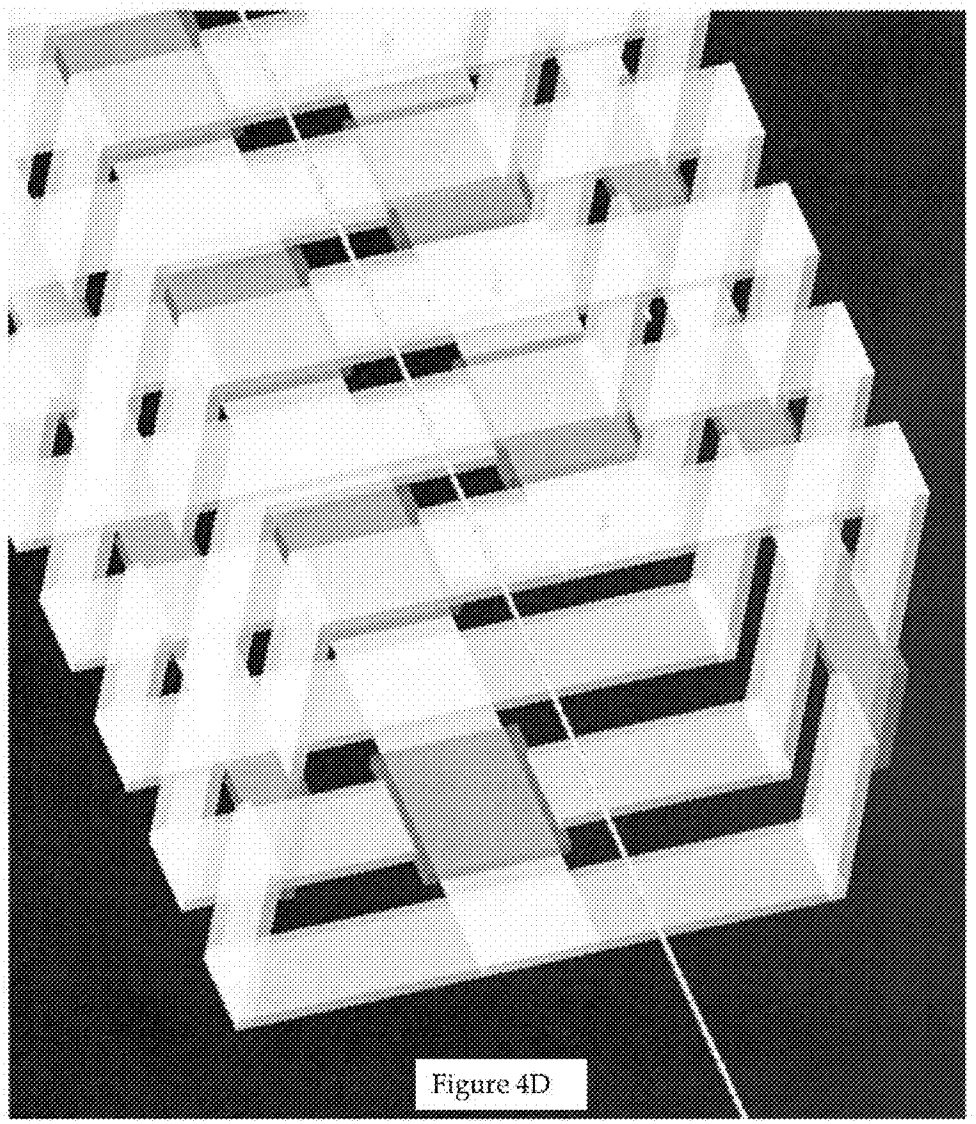
FIG. 4B is an end view of a virtual gap dielectric wall accelerator of the invention.

FIG. 4B shows a virtual gap DWA 110 of the invention. A beam tube 112 of square cross section is positioned in the central channel 108 of bank 100 of induction cells 102. Induction cells 102 have four coaxial feeds 106. As described above, beam tube 112 has locally controllable conductivity. Switches 114 are positioned on the top and bottom of tube 112. The switches 114 are connected together by a strap 116 which surrounds tube 112. The switches 114 and strap 116 are shown in FIG. 4C and form a switch element 118. Strap 116 is an insulator but contains conductors 120 along its edges. The conductors 120 contact the electrodes of switches 114 and connects the switches 114 in parallel. A plurality of switch elements 118 can be connected in series as shown in FIG. 4D to form a switch assembly 122. The switches 114 can be in different positions around the tube, e.g. top, bottom and sides. The conductors 120 allow the switches of each element to be connected in parallel and the elements to be connected electrically in series. Switch assembly 122 is placed along the length of beam tube 112 to locally control conductivity to produce the virtual gap.

Figure 5:
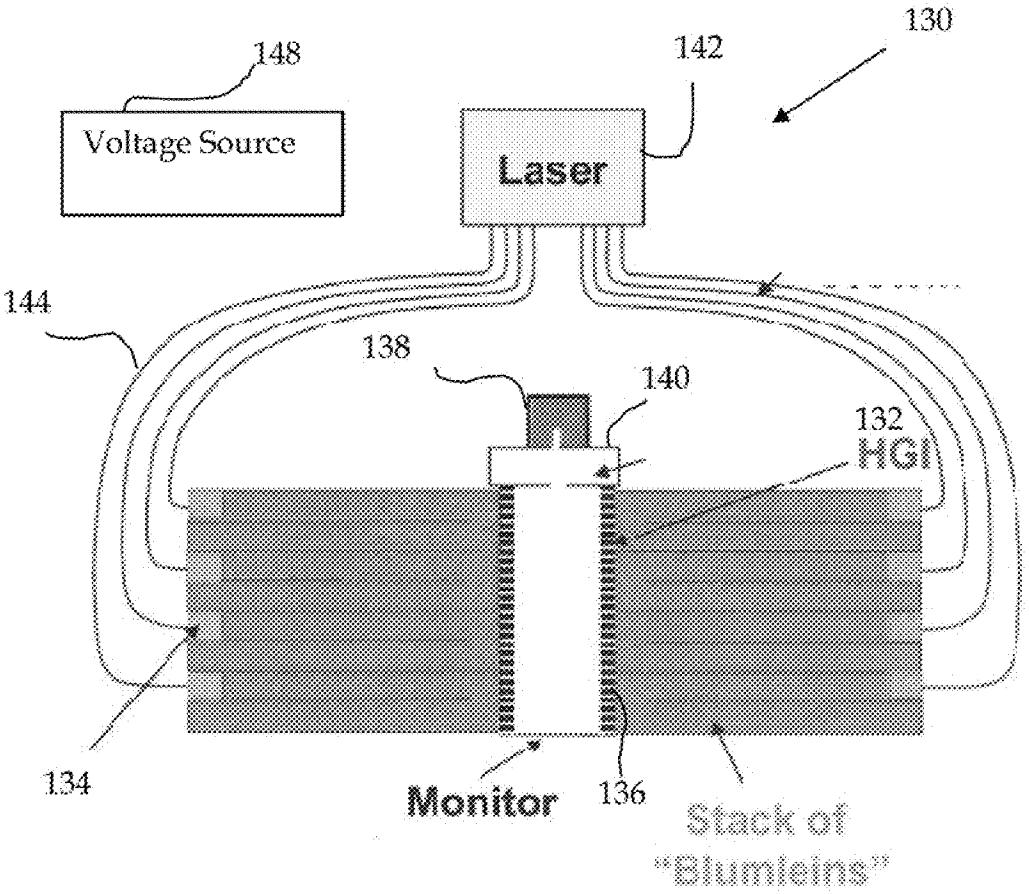
FIG. 5 is a top cross-sectional view of a virtual gap dielectric wall accelerator of the invention.

FIG. 5 shows a virtual gap dielectric wall accelerator (DWA) 130 in greater detail. DWA 130 has a HGI beam tube 132 surrounded by a series arrangement of photoconductive switches 134 forming a variable conductivity layer 136 on HGI tube 132. At one end of beam tube 132 is a charged particle source 138, e.g. a proton source. Charged particles from source 138 pass through focusing element 140 before entering the beam tube 132. Photoswitches 134 are actuated in sequence by light from a laser (or other optical source) 142 that is connected to the photoswitches 134 by optical fibers 144. Laser 142 contains a control system to control the timing of switch actuation so that the virtual gap travels down the beam tube 132 at the desired speed. As the particle speed increases the speed of the virtual gap is increased to stay in synchronization. The induction cells are omitted for simplicity but would be located in the dotted region 146 around the beam tube 132 and would be powered by external voltage source 148.

The area of controlled resistivity along the beam tube is a small portion of the beam tube but is readily achievable. Ideally the width of the virtual gap should be about three times the beam tube radius. For a 2 cm radius beam tube, the virtual gap width would be 6 cm. Thus a switch arrangement to control resistivity at this type of gap width is realistic. More than one switch can be actuated at one time to create the desired pattern.

The switch tube may be configured in such a way as to provide not only an accelerating field but also transverse focusing due to a multipole arrangement of the switch elements. For example, two switches at a given axial location which are oriented opposite to one another and connected by wires or strips can provide a quadrupole electric field. An example is shown in FIGS. 4C, D. In FIG. 4D the 90° alternate position of the switch pairs is to provide focusing in both planes. More switches placed around the axis can give rise to other multipole fields.

The quality and strength of the quadrupole focusing field can be adjusted by shaping the switch electrodes and the conducting strips that connect switches on opposite sides of the accelerator axis. In particular, chevron ("V") shaped strips can provide quadrupole fields. Multiple bends can provide even higher order multipole fields while a simple slant can produce a dipole field. Another configuration that can provide the same focusing is to alternate the conductor strip directions around the circumference of an insulating cylindrical tube every 90° of azimuth in a helical configuration. Net focusing in both transverse planes can be provided by either progressively changing the pitch of the chevrons (as in a helical configuration), or by alternating the orientation of the chevrons by 90°. To increase the resistance of surface flashover along the switch tube, the conducting strips on the chevrons connecting the switches can be arranged to be on opposite sides of the chevrons. Various of these features are illustrated in the following Figures.

Figure 6A:
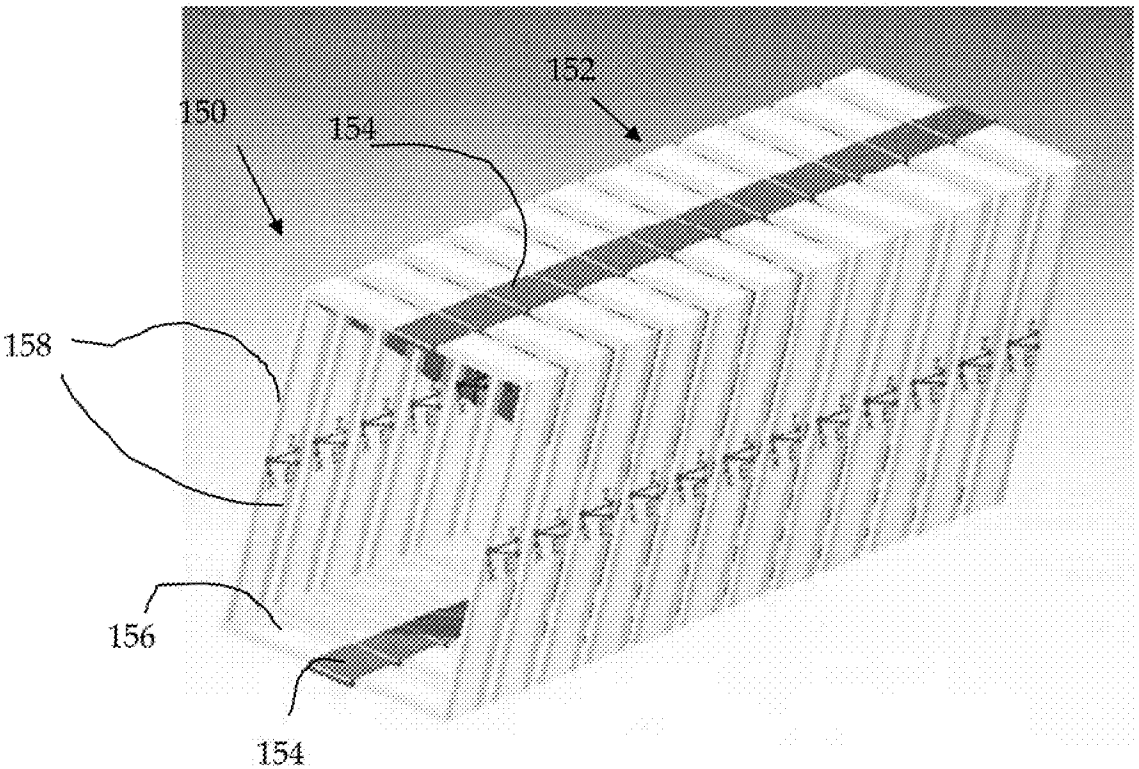
FIGS. 6A-B, 7A-B, 8A-B illustrate switch configurations and interconnecting conductors to provide multipole fields and focusing.

FIG. 6A shows an assembly 150 of switch elements 152 of square cross section, each containing a pair of switches 154, one on the top and one on the bottom. The switches 154 are mounted on insulating straps 156, which have conducting lines 158 attached thereto. Conducting lines 158 are the electrical connections to the switches 154. The conducting lines form a closed path around the switch element 152 so that when a voltage appears across the switches 154 of an element 152, it appears symmetrically around the enclosed beam tube, to produce a symmetric electric field in the tube. A further feature of assembly 150 is that each switch element 152 is tilted along the z-axis (the axis down the beam tube), e.g. the top is tilted forward or backward from the bottom so that the pair of switches is not aligned vertically but slightly offset. This produces an off axis component of the electric field, in this case producing a dipole field.

Figure 6B:
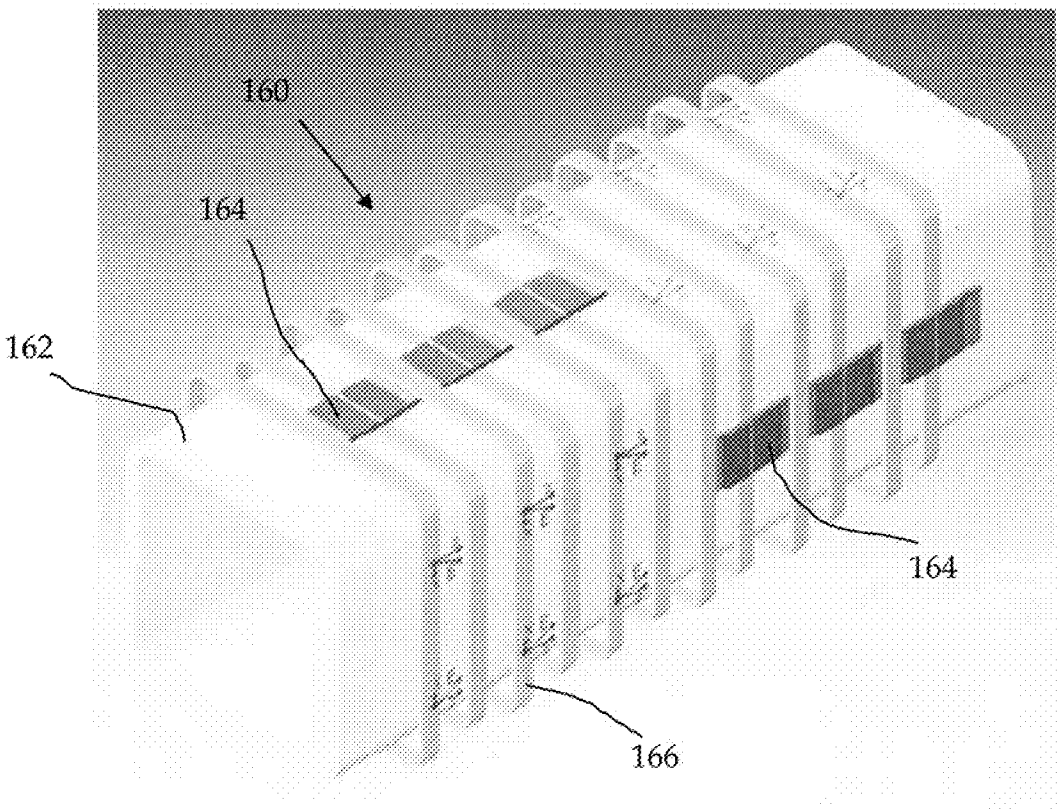

FIG. 6B shows a series switch assembly 160 around a beam tube 162 of square cross section. Six switches 164 are at the top/bottom arrangement followed by six on the sides, producing an alternating quadrupole field. Switch connecting conductors 166 are shown, but the insulating straps have been left out for simplicity. As can be seen adjacent conductors 166 connect to opposite sides of switch 164, to opposed switch electrodes as in FIG. 3A.

Figure 7A:
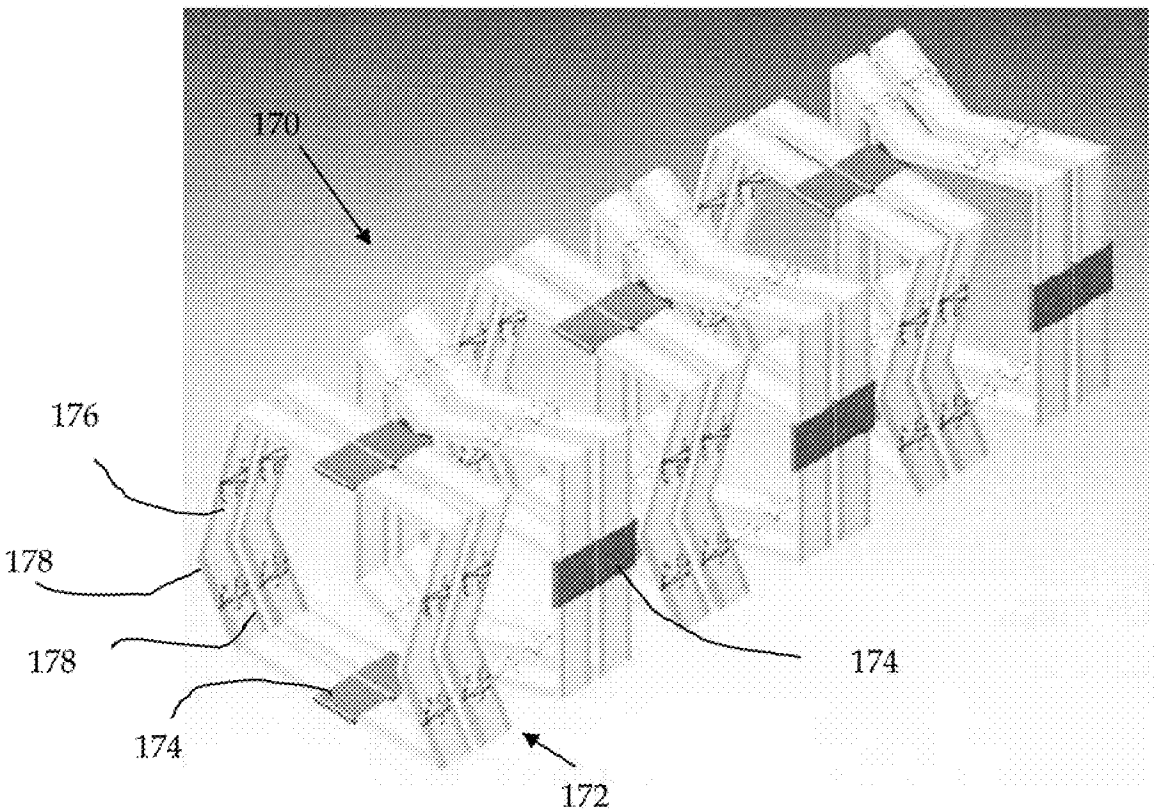

FIG. 7A shows an assembly 170 of switch elements 172 of square cross section, each containing a pair of switches 174. The first two switch elements have one electrode on the top and one on the bottom; the next two have them on the sides, and so forth. The switches 154 are mounted on insulating straps 176, which have conducting lines 178 attached thereto. Conducting lines 178 are the electrical connections to the switches 174. A further feature of assembly 170 is that each switch element 172 has a chevron or "V" shape along the z-axis (the axis down the beam tube). The portion of the straps 176 and the connecting lines 178 on the sides without switches 174 are bent in the middle and extend forward or backward from the switch positions. This also produces an off axis component of the electric field, in this case producing a quadrupole field.

Figure 7B:
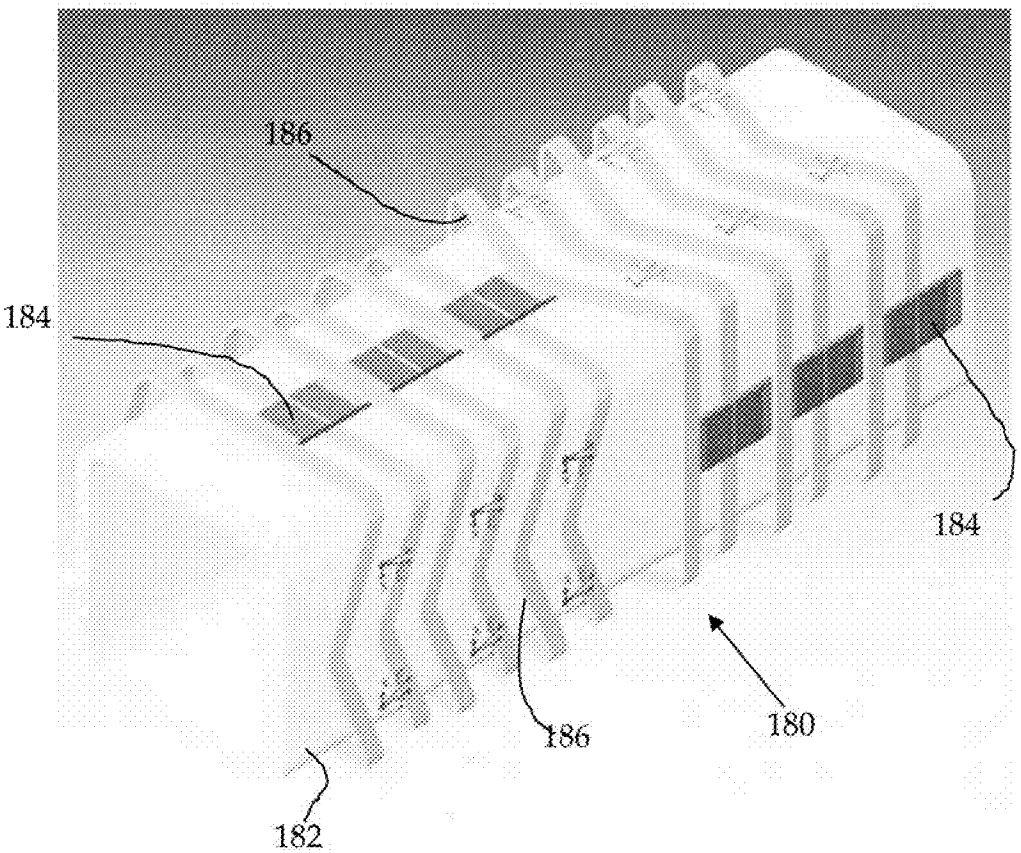

FIG. 7B shows a series switch assembly 180 around a beam tube 182 of square cross section. Six switches 184 are at the top/bottom arrangement followed by six on the sides, producing an alternating quadrupole field. Switch connecting conductors 186 are shown, but the insulating straps have been left out for simplicity. As can be seen adjacent conductors 186 connect to opposite sides of switch 184, to opposed switch electrodes as in FIG. 3A. Conductors 186 (and missing straps) have chevron shapes, producing off axis components of electric field.

Figure 8A:
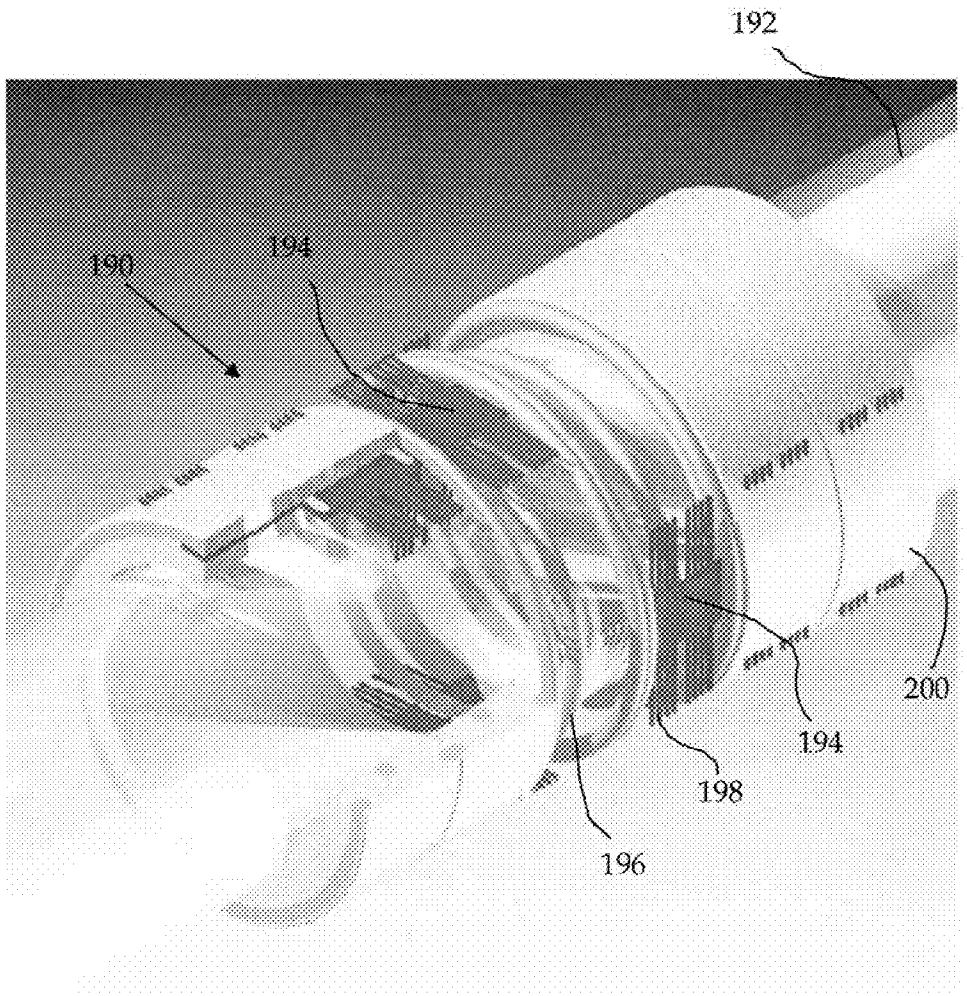

FIG. 8A shows a series switch assembly 190 around a cylindrical beam tube 192. Three switches 194 are at the top/bottom arrangement followed by three on the sides, producing an alternating quadrupole field. Connecting conductors 196 are shown, but the insulating straps have been left out for simplicity. Also shown are optical fibers 198 connecting to the switches 194 to actuate the switches, and a dielectric layer 200 over the switches.

Figure 8B:
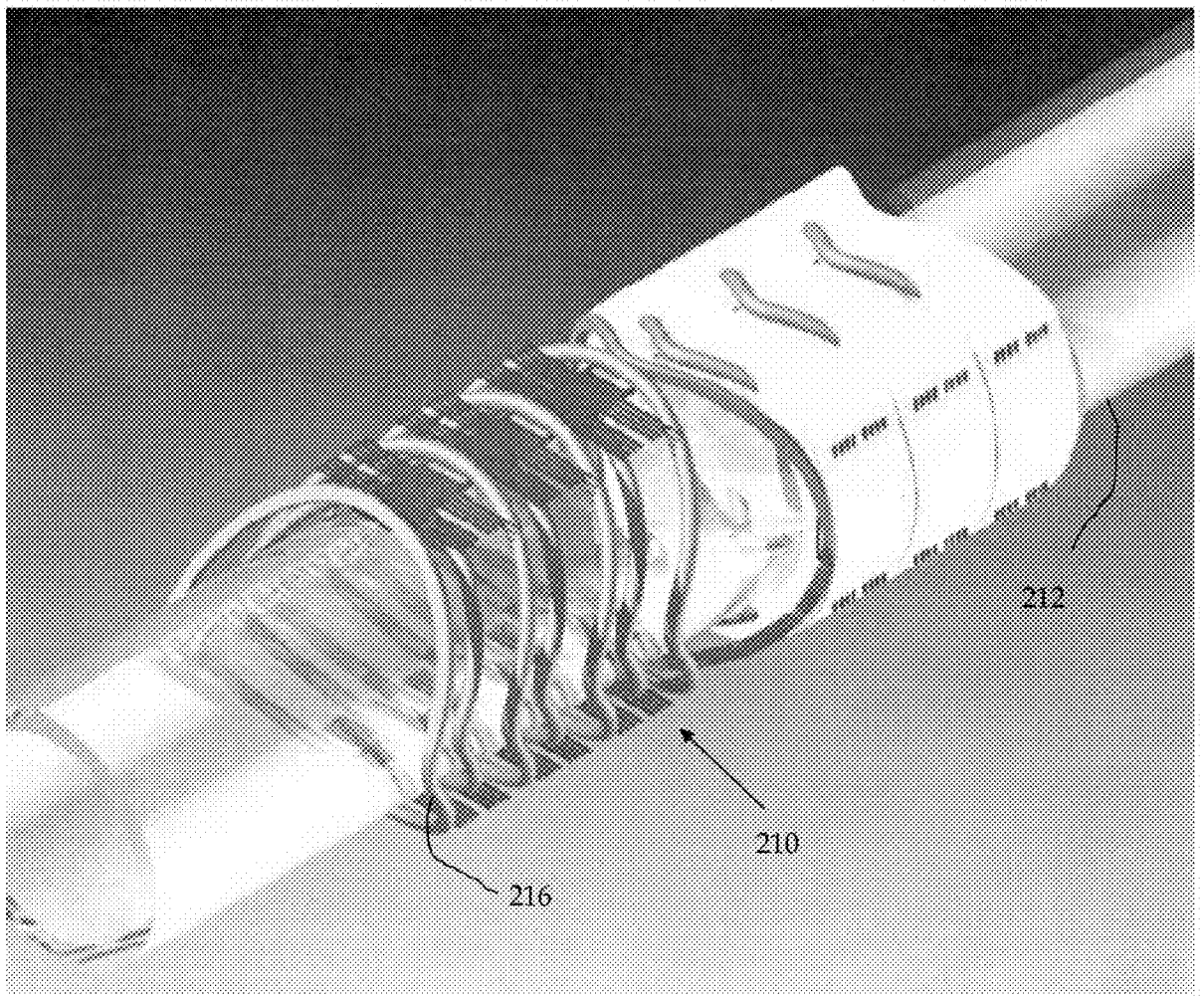

FIG. 8B shows a switch assembly 210 of cylindrical geometry around beam tube 212 with three pairs of top/bottom switches 214 followed by three pairs of side switches 214. Connectors 216 (and missing insulator straps) have chevron shapes to provide off axis field components.

Figure 9:
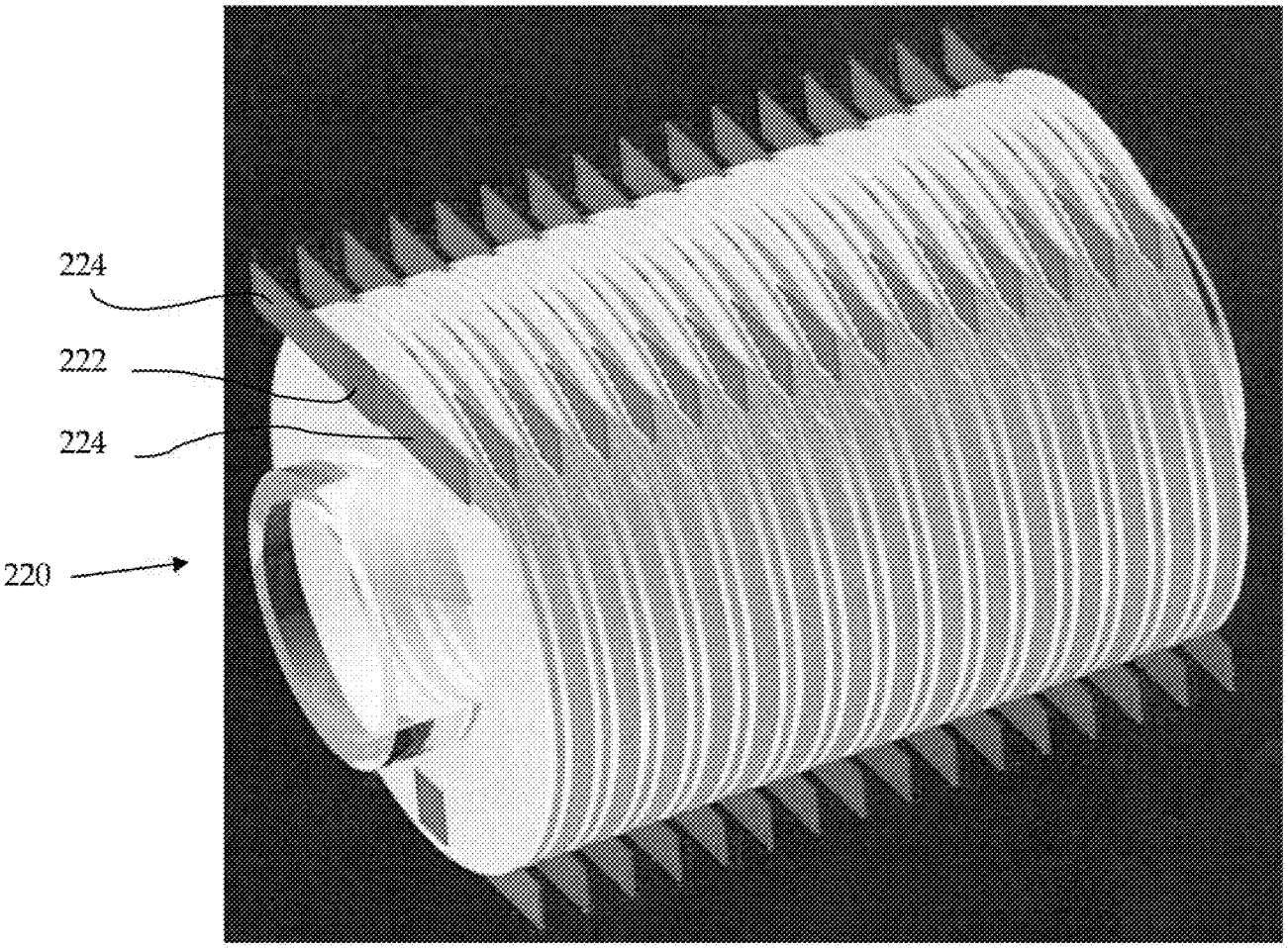
FIG. 9 shows switches vertically mounted and integrated in a HGI beam tube.

FIG. 9 shows an HGI beam tube 220 with vertically mounted switches 222 between successive layers thereof. Pairs of switches 222 are positioned at the top and bottom of tube 220. Also shown are optical fibers connected to the photoswitches 222.

The inherent focusing provided by the chevrons combined with the accelerating pulse allows construction of a single pulse RFQ (radio frequency quadrupole) that is capable of capturing particles from a continuous beam injector and bunching some fraction of the particles into a stable "bucket" that entails both transverse and longitudinal confinement.

The temporal pulse width of the virtual moving gap can be adjusted by suitably varying the temporal characteristics of the laser illumination of the switch elements. The temporal pulse width of the virtual moving gap can also be adjusted by introducing inductance in the interconnecting wires and strips between switch elements.

The invention thus provides a dielectric wall accelerator (DWA) that overcomes some of the limitations of the prior Blumlein DWAs. The virtual gap DWA of the invention has no parasitic coupling, no ringing and a nearly unipolar accelerating pulse. The switches are under maximum voltage for only about 1 ns while opening. There are far fewer switches, about 0.2 to 0.4 switches per mm. While there are still strong radial defocusing forces on the particles, solenoidal focusing can be provided.

The invention is particularly directed to producing a compact proton accelerator for cancer therapy. The goal is an accelerator 2 m long that can produce 200 MeV protons, with up to 50 Hz pulse repetition rate.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element or component is explicitly recited in the claims. No claim element herein is to be construed under the provisions of 35 U.S.C. 112, sixth paragraph, unless the element is expressly recited using the phrase "means for."

We claim:

1. A virtual gap dielectric wall accelerator (DWA), comprising:

a beam tube of locally controllable conductivity having a moving virtual gap formed thereon by sequentially temporarily decreasing the conductivity of a localized region compared to the rest of the tube; and a voltage source connected to the beam tube;

wherein substantially all the voltage from the voltage source appears at the moving region of decreased conductivity and creates an associated moving electric field that accelerates charged particles traveling down the tube.

2. The DWA of claim 1, wherein the beam tube comprises a tube of high gradient insulator (HGI) material, wherein said DWA further comprises a layer of conductive material formed on the tube.

3. The DWA of claim 2, wherein the conductive material is a photoconductive material.

4. The DWA of claim 3, further comprising a light source optically coupled to the layer of photoconductive material to illuminate most portions of the layer to make those portions conductive and to temporarily not illuminate sequential localized regions between the illuminated portions to decrease their conductivity.

5. The DWA of claim 2, wherein the layer of conductive material comprises a plurality of photoconductive switches connected in series along the surface of the HGI tube.

6. The DWA of claim 5, further comprising a light source optically coupled to the photoconductive switches to illuminate most of the switches to make those switches conductive and to temporarily not illuminate one or more switches at sequential localized regions between the illuminated switches to decrease the conductivity of the non-illuminated switches.

7. The DWA of claim 5, wherein each photoconductive switch comprises a substantially thin long substrate of wide band gap semiconductor material and a pair of electrodes on the substrate on opposed sides and near opposed ends of the substrate.

8. The DWA of claim 5, wherein plurality of photoconductive switches comprises at least a pair of electrically connected switches at each axial position along the length of the beam tube.

9. The DWA of claim 8, wherein the plurality of photoconductive switches comprises a pair of electrically connected switches at each axial position at 180° opposed positions along the length of the beam tube.

10. The DWA of claim 9, wherein the plurality of photoconductive switches comprises a first pair of opposed electrically connected switches at a first axial position along the length of the beam tube and a second pair of opposed electrically connected switches at a second axial position along the length of the beam tube, the first pair and second pair being rotated by 90° from each other.

11. The DWA of claim 9, further comprising an insulating strap on which the pair of opposed switches is mounted and a pair of conductors mounted on the strap and electrically connecting the pair of switches.

12. The DWA of claim 11, wherein the insulating strap and pair of conductors has a bend in the direction of the beam tube axis therein.

13. The DWA of claim 12, wherein the bend is chevron or V shaped.

14. The DWA of claim 11, wherein the insulating strap and pair of conductors are tilted in the direction of the beam tube axis.

15. The DWA of claim 1, wherein the voltage source is a stack of spaced induction cells encircling the beam tube.

16. The DWA of claim 15, further comprising an external voltage source connected to the stack of induction cells by coaxial cables.

17. The DWA of claim 15, wherein each induction cell comprises a conducting container, a magnetic core material in the container, and a focusing solenoid in the container.

18. The DWA of claim 15, further comprising a plurality of magnetic cores encircling the beam tube along at least a portion of its length between the beam tube and the encircling stack of induction cells.

19. The DWA of claim 1, wherein the beam tube comprises a stalk in an induction adder.

20. The DWA of claim 1, further comprising a plurality of magnetic cores encircling the beam tube along at least a portion of its length.

21. The DWA of claim 1, wherein the beam tube comprises a tube of high gradient insulator (HGI) material, and a helical conductor wound around the HGI tube along at least a portion of its length.

22. The DWA of claim 21, wherein the voltage source is a stack of spaced induction cells encircling the beam tube and an external voltage source connected to the stack of induction cells; and each induction cell comprises a conducting container; a capacitor, a switch, and a magnetic core material connected in series in the container; and a focusing solenoid in the container.

23. The DWA of claim 22, wherein all switches in the induction cells are initially closed, and then opened in sequence to create the virtual gap along the helical conductor wound around the beam tube.

24. A method of accelerating a charged particle, comprising:

passing the charged particle through a beam tube of locally controllable conductivity;

applying a voltage to the beam tube; and sequentially temporarily decreasing the conductivity of the beam tube at a localized region along its length to produce a much higher resistivity moving virtual gap where substantially all the voltage applied to the beam tube appears and creates an associated moving electric field that accelerates the charged particle traveling down the tube.

25. The method of claim 24, further comprising timing the sequential temporary decreasing of the conductivity of the beam tube at a localized region so that the virtual gap moves synchronously with the charged particle moving down the beam tube.

26. The method of claim 24, wherein the sequential temporary decreasing of the conductivity of the beam tube at a localized region is performed optically.

27. The method of claim 24, further comprising:

forming the beam tube of a tube of high gradient insulator (HGI) material and a layer of photoconductive material on the HGI tube; and illuminating most portions of the layer to make those portions conductive and temporarily not illuminating sequential localized regions between the illuminated portions to decrease their conductivity.

28. The method of claim 24, further comprising:

forming the beam tube of a tube of high gradient insulator (HGI) material and a plurality of photoconductive switches connected in series along the surface of the HGI tube; and illuminating most of the switches to make those switches conductive and temporarily not illuminating one or more switches at sequential localized regions between the illuminated switches to decrease the conductivity of the non-illuminated switches.

29. The method of claim 24, wherein applying a voltage to the beam tube comprises electrically connecting the beam tube to a stack of spaced encircling induction cells.

30. The method of claim 24, further comprising increasing the series inductance per unit length along at least a portion of the beam tube to operate in the superluminal regime.

31. The method of claim 24, further comprising:

forming the beam tube of a tube of high gradient insulator (HGI) material and a plurality of photoconductive switches electrically connected along the surface of the HGI tube; and arranging the switches to produce multipole electric fields.

32. A virtual gap dielectric wall accelerator (DWA), comprising:

a beam tube of locally controllable conductivity;

a voltage source connected to the beam tube; and means for sequentially decreasing the conductivity of the beam tube at a localized region moving along its length to produce a much higher resistivity so that a moving virtual gap is created where substantially all the voltage from the voltage source appears and creates an associated electric field that accelerates charged particles traveling down the tube.

33. The DWA of claim 32, wherein the beam tube comprises a tube of high gradient insulator (HGI) material and a layer of conductive material formed on the HGI tube; and the means for sequentially decreasing the conductivity of the beam tube at a localized region comprises a light source optically coupled to the layer of photoconductive material to illuminate most portions of the layer to make those portions conductive and to temporarily not illuminate sequential localized regions between the illuminated portions to decrease their conductivity.

34. The DWA of claim 32, wherein the beam tube comprises a tube of high gradient insulator (HGI) material and a plurality of photoconductive switches connected in series along the surface of the HGI tube; and the means for sequentially decreasing the conductivity of the beam tube at a localized region comprises a light source optically coupled to the photoconductive switches to illuminate most of the switches to make those switches conductive and to temporarily not illuminate one or more switches at sequential localized regions between the illuminated switches to decrease the conductivity of the non-illuminated switches.

35. The DWA of claim 32, wherein the voltage source is a stack of spaced induction cells encircling the beam tube.

36. The DWA of claim 32, further comprising a plurality of magnetic cores encircling the beam tube along at least a portion of its length.

37. The DWA of claim 32, wherein the beam tube comprises a tube of high gradient insulator (HGI) material and a helical conductor wound around the HGI tube along at least a portion of its length, wherein the voltage source comprises a stack of spaced induction cells encircling the beam tube and an external voltage source connected to the stack of induction cells, each induction cell comprising a conducting container; a capacitor, a switch, and a magnetic core material connected in series in the container; and a focusing solenoid in the container, and wherein all switches in the induction cells are initially closed, and then opened in sequence to create the virtual gap along the helical conductor wound around the beam tube.

38. The DWA of claim 32, further comprising means to configure the DWA to operate in the superluminal regime.

39. The DWA of claim 32, further comprising means to produce multipole fields.

40. The DWA of claim 32, further comprising means to provide beam focusing.

* * * * *